US008864347B2

(12) United States Patent
Pearson et al.

(10) Patent No.: US 8,864,347 B2
(45) Date of Patent: Oct. 21, 2014

(54) CONCATENATABLE LINEAR LED LIGHTING FIXTURES

(75) Inventors: Dennis Pearson, Foothill Ranch, CA (US); Wesley Scott Dochnahl, Upland, CA (US); Guang Jin, Santa Monica, CA (US); Jorge Santana, Irvine, CA (US)

(73) Assignee: Tempo Industries, LLC, Irvine, CA (US)

( * ) Notice: Subject to any disclaimer, the term of this patent is extended or adjusted under 35 U.S.C. 154(b) by 267 days.

(21) Appl. No.: 13/448,720

(22) Filed: Apr. 17, 2012

(65) Prior Publication Data

US 2013/0272000 A1 Oct. 17, 2013

(51) Int. Cl.
*F21V 15/01* (2006.01)
*F21S 2/00* (2006.01)
*F21Y 101/02* (2006.01)

(52) U.S. Cl.
CPC ..... *F21S 2/005* (2013.01); *F21Y 2101/02* (2013.01)
USPC ..... 362/362

(58) Field of Classification Search
CPC ..... F21S 2/005; F21S 4/008; F21Y 2101/02
USPC ..... 362/362
See application file for complete search history.

(56) References Cited

U.S. PATENT DOCUMENTS

| | | | | |
|---|---|---|---|---|
| 7,726,840 | B2 | 6/2010 | Pearson et al. | |
| 8,002,426 | B2 | 8/2011 | Pearson et al. | |
| 8,061,870 | B2 | 11/2011 | Pearson et al. | |
| 8,398,276 | B2 | 3/2013 | Pearson et al. | |
| 2008/0259632 | A1* | 10/2008 | Chien | 362/565 |

* cited by examiner

*Primary Examiner* — Britt D Hanley
(74) *Attorney, Agent, or Firm* — Greenberg Traurig LLP; Franklin D. Ubell

(57) ABSTRACT

An illustrative modular light fixture apparatus may comprise a plurality of modules, each having a base component and a cover component. The base component has a split vertical male plug positioned within a cylindrical recess, and a cylindrical female receptacle formed at an opposite end thereof. The cylindrical female receptacle and split male plug are so configured such that the female receptacle of one module will snap fittingly or otherwise interconnect with the split male plug of another module. The cover component has respective pairs of rectangular openings on first and second sides thereof configured to snap fittingly engage respective tabs on the sides of the base component as the cover component is pushed downwardly over the base component to thereby attach the cover component to the base component.

10 Claims, 10 Drawing Sheets

CONCATENATABLE LINEAR LED LIGHTING FIXTURES

BACKGROUND

1. Field

The subject disclosure relates to lighting fixtures and more particularly to smaller scale articulated LED light fixtures offering adjustability and ease of assembly and installation of a series of interconnectable lighting units or modules.

2. Related Art

Various decorative and/or accent linear lighting apparatus such as rope light, luminous incandescent lighting, and festoon lighting have been in use for some time.

BRIEF SUMMARY

The following is a summary description of an illustrative concatenatable modular LED lighting fixture embodiment. It is provided as a preface to assist those skilled in the art to more rapidly assimilate the detailed design discussion which ensues and is not intended in any way to limit the scope of the claims which are appended hereto in order to particularly point out the invention.

An illustrative modular light fixture apparatus may comprise a plurality of modules, each having a base component and a cover component. The base component has respective pairs of resilient tabs on first and second sides thereof, each resilient tab having a plurality of vertical ridges formed thereon. The cover component further has respective pairs of rectangular openings on first and second sides thereof, which are so positioned, shaped and dimensioned that they snap fittingly engage the resilient tabs on the base component as the cover component is pushed downwardly over the base to thereby attach the cover component to the base component.

The base component further has a cylindrical recess formed at a first end and a split vertical male plug positioned within the cylindrical recess. A cylindrical female receptacle having a hole therein is formed at a second, opposite end of each base component and is positioned within first and second outer fingers. The cylindrical female receptacle and split male plug are so positioned, shaped, and dimensioned that the female receptacle of one base component snap fittingly engages or otherwise interlocks or interconnects with the split male plug of another base component.

DETAILED DESCRIPTION

Figure 1:
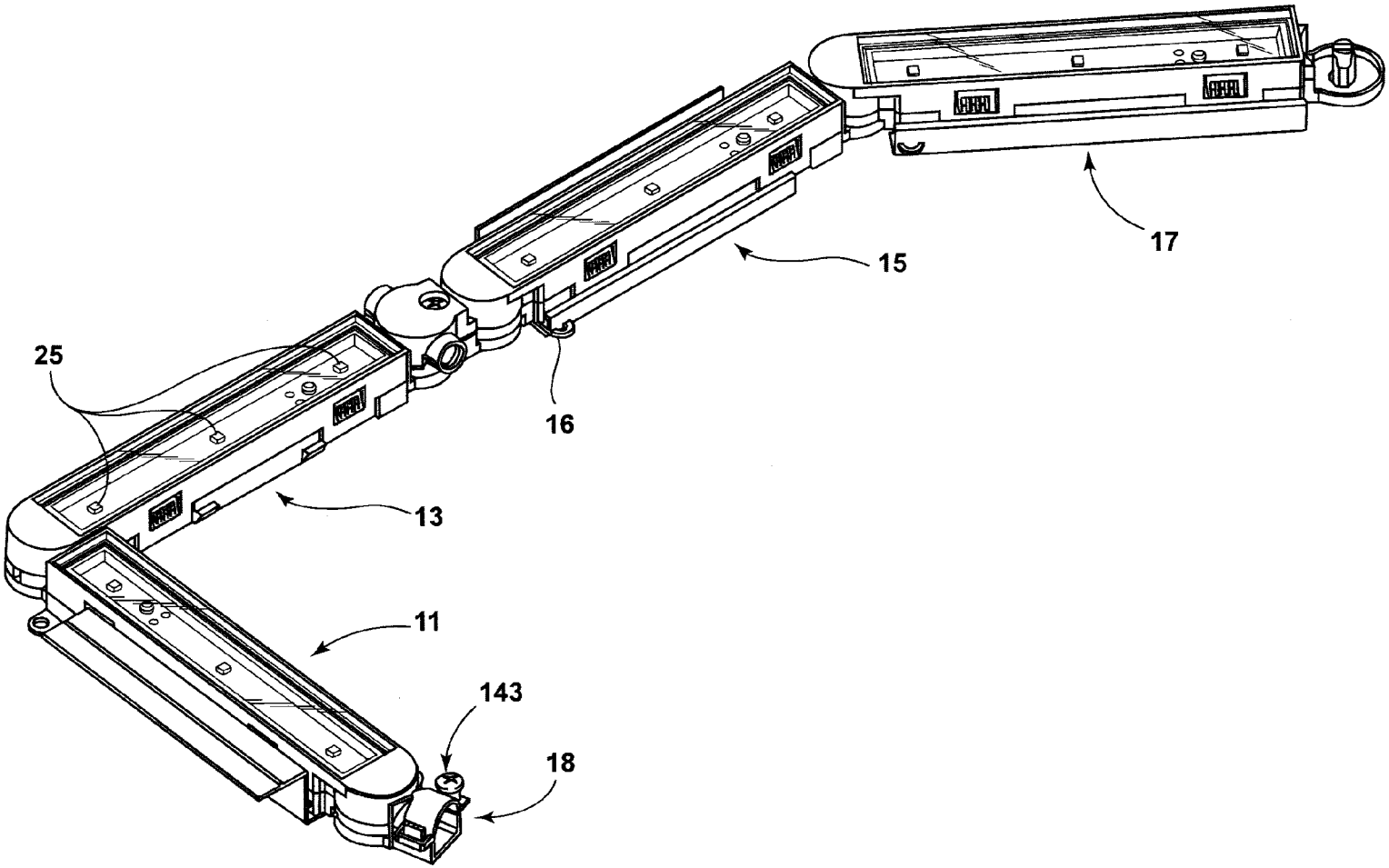
FIG. 1 is a perspective view illustrating concatenation of a number of light fixture modules according to an illustrative embodiment.

FIG. 1 is a perspective view of lighting apparatus according to an illustrative embodiment. FIG. 1 illustrates a series of individual LED light fixtures or modular units 11, 13, 15, 17 interconnected together in articulated fashion. A conduit feed clamp 18 is pivotally mounted at an end of one unit 11 in order to receive and hold as electrical conduit feed.

Figure 2:
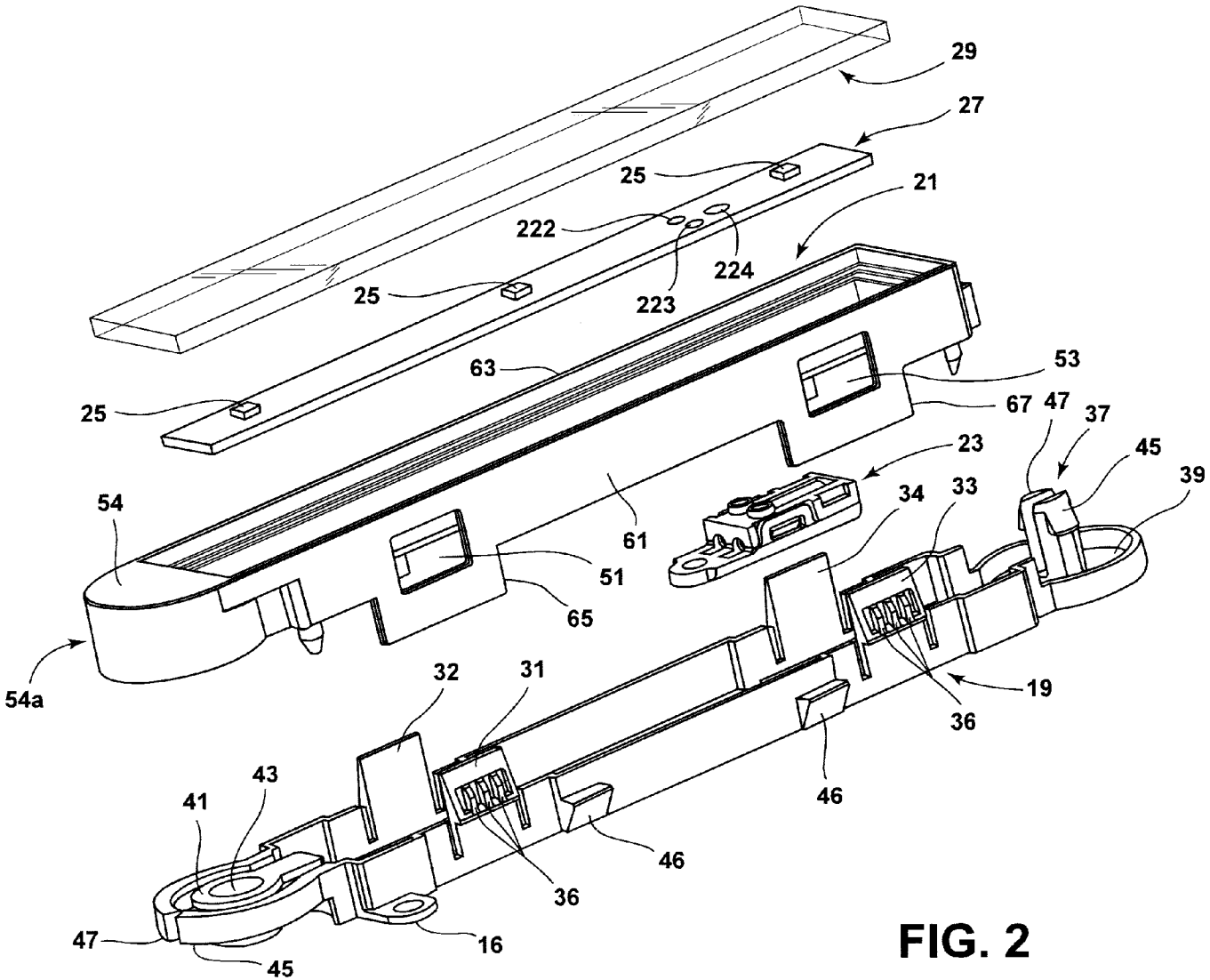
FIG. 2 is a perspective exploded view of an illustrative modular light fixture unit.

As shown in FIG. 2, each modular unit 11, 13, 15, 17, includes a base 19 and a cover 21. In one embodiment, the base 19 may be fabricated of a plastic material such as nylon, while the cover member may be fabricated of a metal having suitable thermal or heat sinking characteristics, such as, for example, the zinc alloy ZAMAK 3. Other materials may be used in other embodiments. Horizontally extending tabs, e.g., 16, with holes therein may be formed along the bottom edges of the base unit 19, and may be trimmable for removal as desired in one embodiment.

Figure 9:
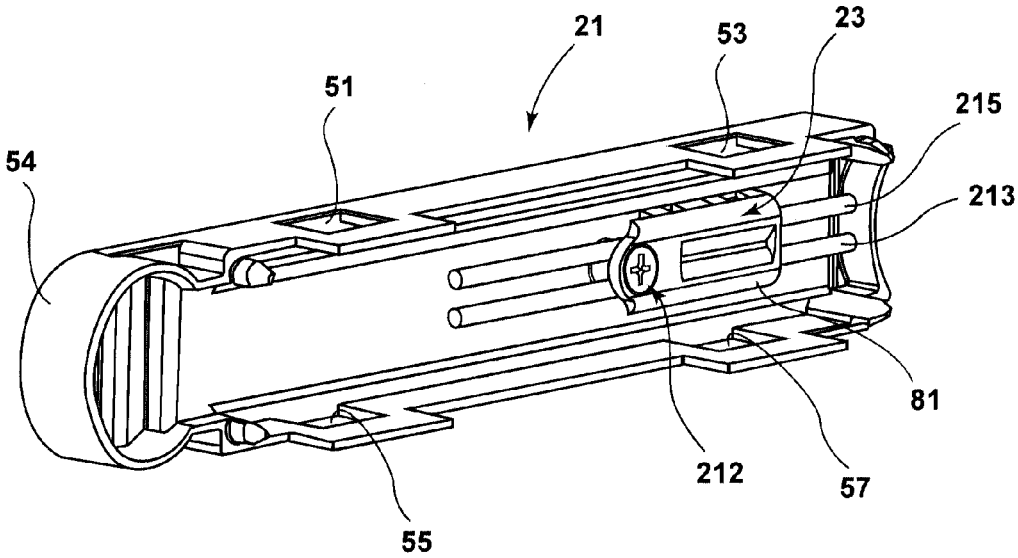
FIG. 9 is a bottom perspective view of an illustrative cover component illustrating attachment of the pin holder of FIGS. 7 and 8 in an illustrative embodiment.

A pin holder 23 is attached to the underside of the cover member 21 by a screw 212 as shown in FIG. 9. The pin holder 23 receives electrical leads 213, 215 and holds two power pins 217, 219 in position to supply power to LEDs, e.g., 25 mounted on a circuit board 27. The circuit board 27 is supported by the cover member 21, which further may receive and mount a colored gel or acrylic member 29 to change the color of the light output from the modular unit, if desired, and to protect the underlying printed circuit board 27. In one embodiment, the circuit board 27 may be about five inches long with an overall cover length of about six inches.

Figure 3:
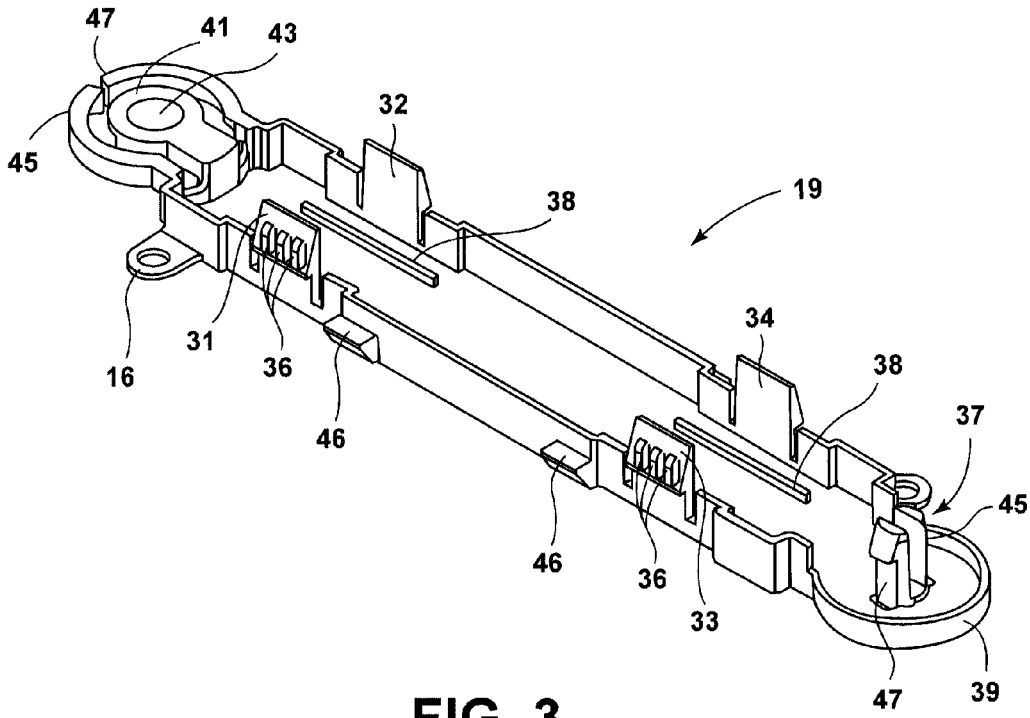
FIG. 3 is a perspective view of a base component according to an illustrative embodiment.
Figure 4:
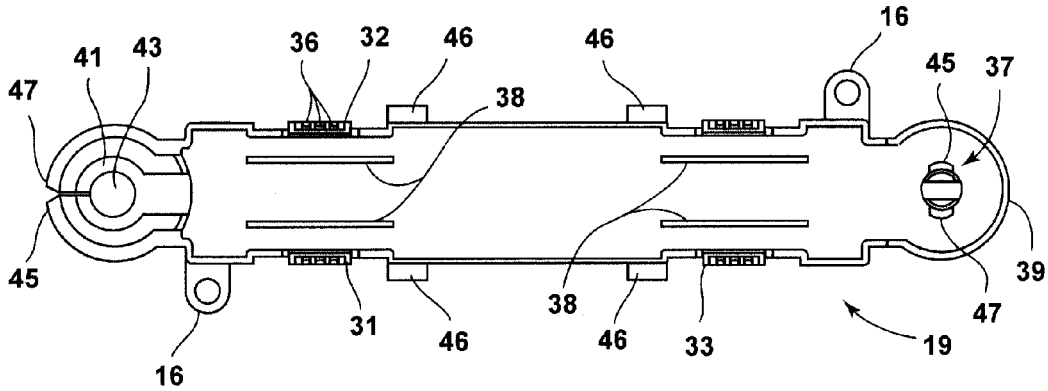
FIG. 4 is a top view of the base component of FIG. 3.

As seen in FIGS. 2-4, the base 19 has a pair of resilient tabs 31, 33 on a first side thereof and a second pair of resilient tabs 32, 34 on a second side thereof. In the illustrated embodiment, each tab 31, 32, 33, 34 has three vertical ridges 36 formed thereon, which may taper outwardly and downwardly along their respective upper ends.

A split vertical male plug 37 is concentrically positioned within a cylindrical recess 39 at one end of the base 19, while a generally cylindrical female receptacle 41 having a cylindrical hole 43 formed therethrough is formed at the opposite end of the base 19. The female receptacle 41 is positioned within two outer fingers 45, 47, which, in one embodiment, have a common inner radius and share a common center with the female receptacle 41. Tabs 46 are disposed along the lower edge of the base 19, to facilitate attachment of the units, e.g. 11, 13, 15, 17, to a mounting track as described further below.

In one embodiment, the split male plug 37 and female receptacle 43 are so shaped and dimensioned as to create a snap-fit relationship between the female receptacle 43 of one module, e.g., 11, and the male plug 37 of another module e.g. 13, such that adjacent modules may be snapped together. In one embodiment, once snapped together, the cover member 21 must be removed from the base 19 in order to pinch the "fingers" 45, 47, of the male plug together to enable disconnecting the previously snapped-together units. The ridges 38 on the floor of the base 19 shown in FIGS. 3 and 4 provide strength to the unit.

The cover member or component 21 has respective pairs of rectangular openings, 51, 53, 55, 57 on each of its side surfaces 61, 63 and a depending generally rectangular surface, e.g. 65, 67 formed as part of the side surface and disposed beneath each of the openings 51, 53, 55, 57. In one embodiment, the rectangular openings 51, 53, 55, 57 and depending surfaces 65, 67 are so shaped and dimensioned that the inner surfaces of the depending rectangular surfaces 65, 67 initially contact the vertical projections 36 on the base 19 as the cover 21 is positioned over the base 19 and pushed downwardly onto it, thereby pressing the tabs 31, 33, 32, 34 inwardly and thereafter allowing the tabs 31, 32, 33, 34, to snap fit into the respective openings 51, 53, 55, 57 to thereby snap-fittingly attach the cover 21 to the base 19.

The cover member 21 further has a semi-cylindrical cap 54 formed at a nose end 54*a* thereof, which, in one embodiment, is sized to mate flushly with the respective fingers 45, 47 to further close the unit. Exemplary dimensions of one illustrative embodiment are nose radius R=0.450 inches and length A of the floor 56=4.95 inches.

Figure 5:
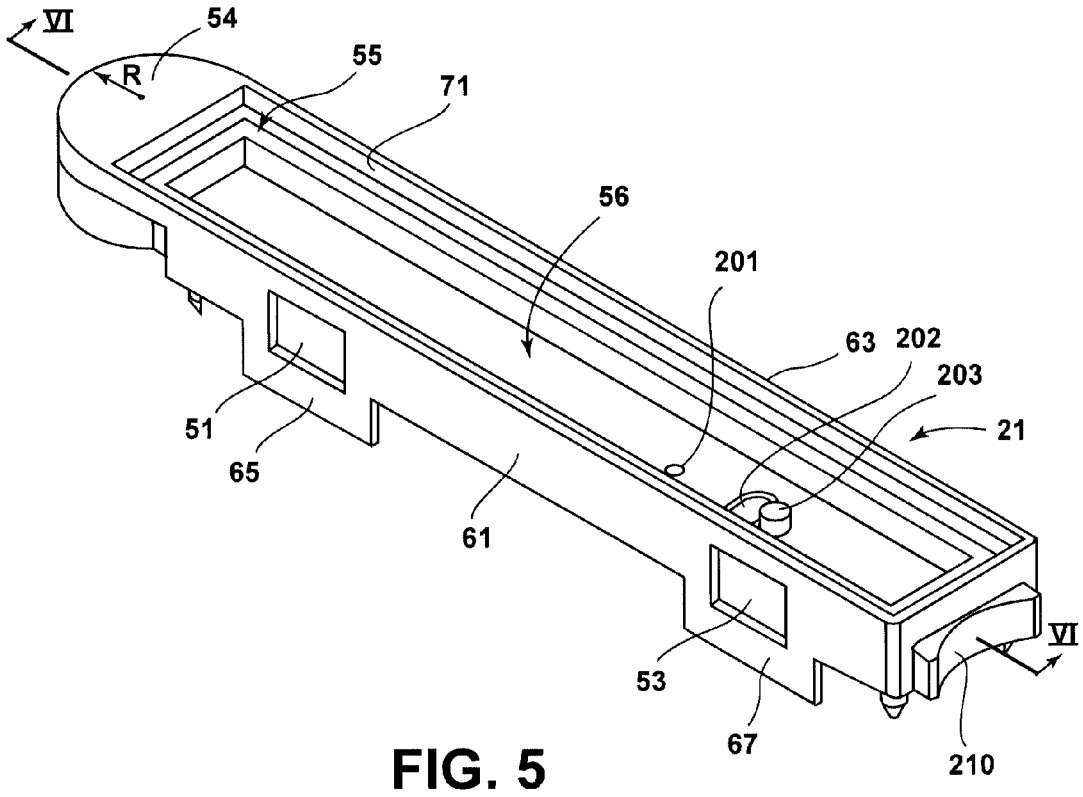
FIG. 5 is a perspective view of a cover component according to an illustrative embodiment.
Figure 6:
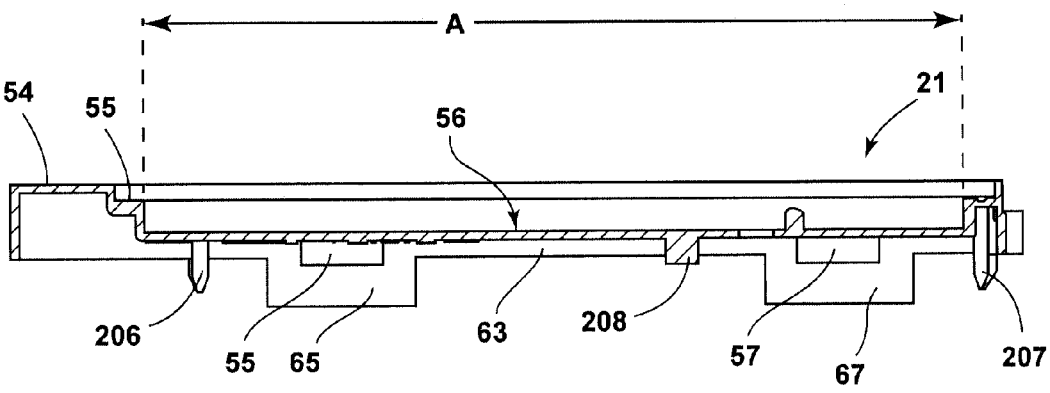
FIG. 6 is a side sectional view taken at VI-VI of FIG. 5.
Figure 10:
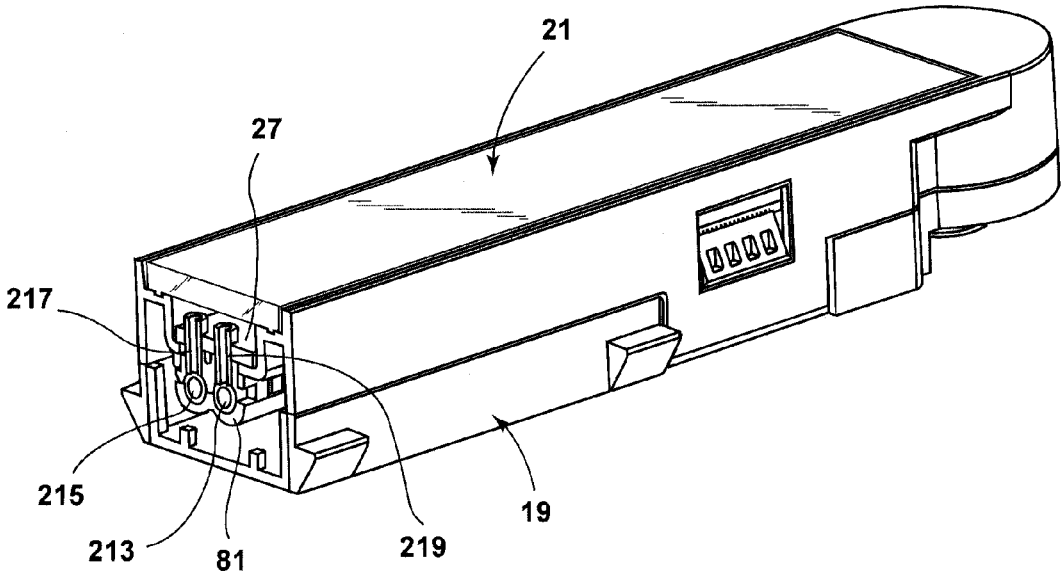
FIG. 10 is a perspective sectional view illustrating positioning of conductor pins and their pin holder in an illustrative embodiment.

As seen particularly in FIG. 5, the cover member 21 has a rectangular edge or lip 55 formed in its interior to provide a ledge upon which the lens 29 (FIG. 2) rests and an adjacent vertical wall 71 which further serves to position the lens 29. The circuit board 27 rests on the floor 56 of the cover member 21, and in one embodiment is attached using thermal tape to facilitate heat transfer. In other embodiments, a topical coating such as grease, paste, or oil that aids in heat dissipation may be employed. The floor 56 includes a hole 201 to receive the pin holder mounting screw 212 (FIG. 9), i.e., an opening 202 through which the conductive pins 217, 219 (FIG. 10) extend, and a cylindrical post 203, which fits through a hole 224 in the PCB 27 and serves to align the PCB 27. The cover member 21 further includes respective assembly alignment pins 206, 207 and a boss 208 within which the hole 201 is formed. An arcuate surface 210 is shaped to mate with the nose end 54*a* of an adjacent unit.

Illustrative embodiments may provide small scale lighting outputs from, for example, 100 to 200 lumens/ft with adjustability and ease of installation. Such embodiments may further employ 3 ML-B or 3 ML-E LED units on each circuit board 27 or roughly 3 such units every 6 inches with power consumption of, for example, 40 to 55 lumens per watt. In one embodiment, each circuit board may mount a 12 volt A.C. bridge circuit for DC conversion. The power supply located remotely from the unit may provide 12 volts A.C. with 50 or 25 foot runs of the 3 ML-B or 3 ML-E units, respectively. Such units may be direct cove mounted or mounted by use of an edge or wall mounting track as described above. Thermal management and heat dissipation is adequately provided by the ZAMAK 3 material from which the illustrative cover 21 may be fabricated.

Figure 7:
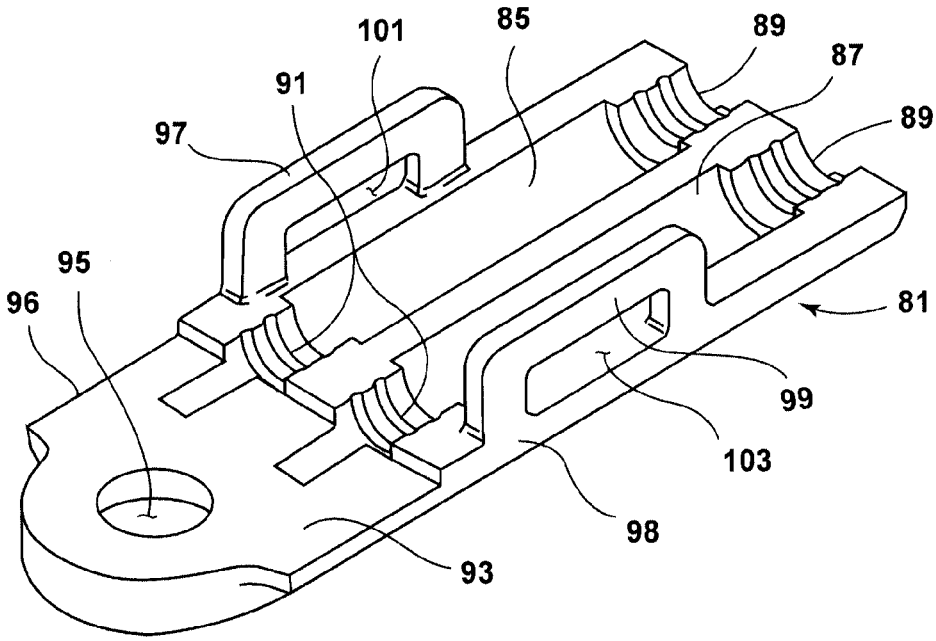
FIG. 7 is a perspective view of a bottom half of a pin holder according to an illustrative embodiment.
Figure 8:
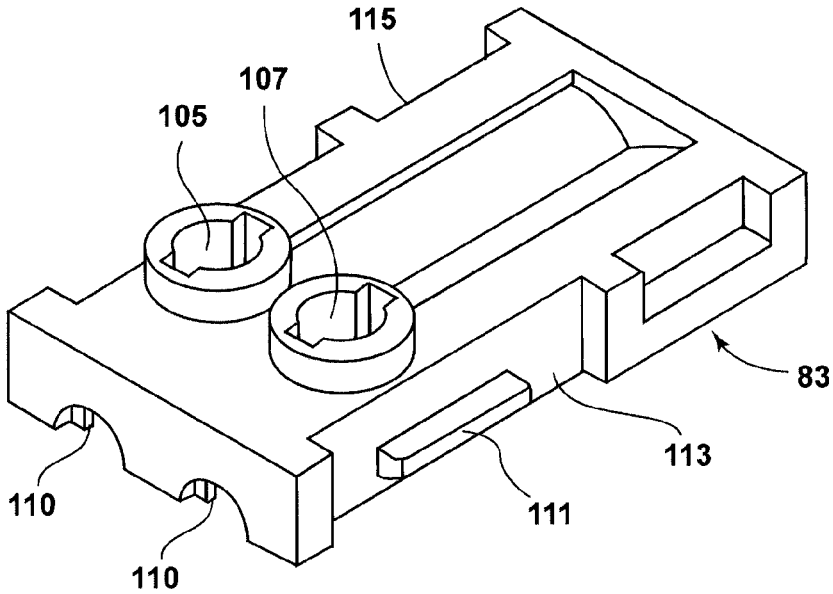
FIG. 8 is a perspective view of a top half of a pin holder according to an illustrative embodiment.

FIGS. 7 and 8 illustrate the bottom half 81 and top half 83 of the pin holder 23 of FIG. 2, which may be fabricated of a plastic such as nylon. The bottom half 81 includes central wire channels 85,87 of semicircular cross-section located between respective entry ways 89 and exit ways 91. The bottom half 81 further includes a tab 93 formed at the front thereof, which includes a mounting hole 95. Respective vertically standing side rails 97, 99 with respective rectangular openings 101, 103 are formed on opposite sides 96, 98 of the bottom half 81.

The top half 83 of the pin holder 23 show in FIG. 8 includes pin exit openings 105, 107, respective wire way entry openings (not shown) and exit openings 110. Semicircular channels similar to the channels 85, 87 are formed in the interior of the top half 83, such that respective electrical conductors 213, 215 can be clamped within the pin holder 23 when the top half 83 and bottom half 81 are mated together.

Respective tabs, e.g., 111 are formed on respective sides 113, 115 of the top half 81 and are positioned, shaped and dimensioned to snap-fittingly engage the respective rectangular openings 101, 103 of the side rails 97, 99 of the bottom half 81 to thereby join the two components 81, 83 together after electrical conductors 213, 215 and pins 217, 219 have been appropriately placed in the bottom half 81.

FIG. 9 shows the pin holder 23 mounted to the underside of the cover component 21 by a screw 212. Electrical leads 213, 215 enter the pin holder and supply two upright or vertical electrically conductive pins 217, 219 seen in FIG. 10. These pins 217, 219, extend through holes 105, 107 in the pin holder 23, through the opening 202 in the floor of the cover member 21 and then through the respective holes 221, 223, in the PCB 23 (FIG. 2) to supply power to the components mounted on the printed circuit board 23.

Figure 11:
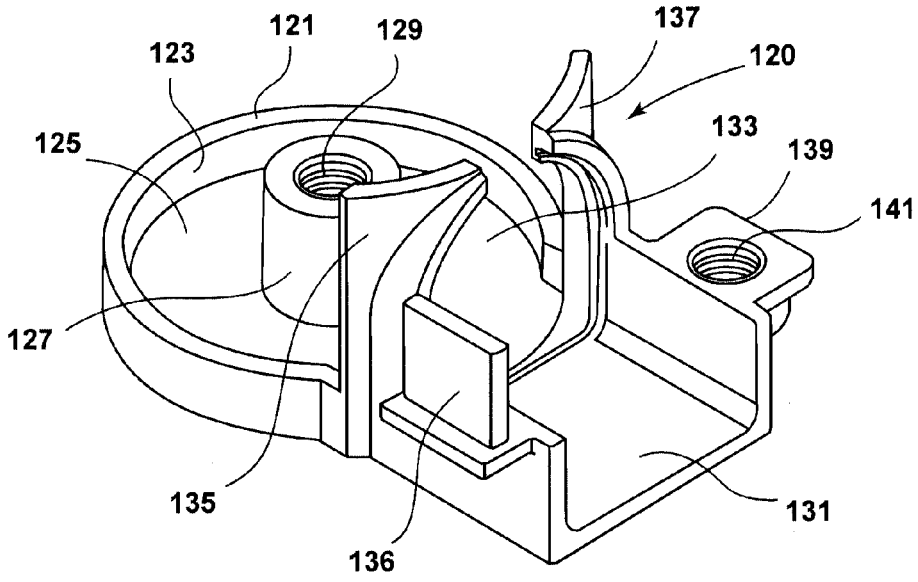
FIG. 11 is a perspective view of a bottom half of an electrical conduit feed clamp according to an illustrative embodiment.
Figure 12:
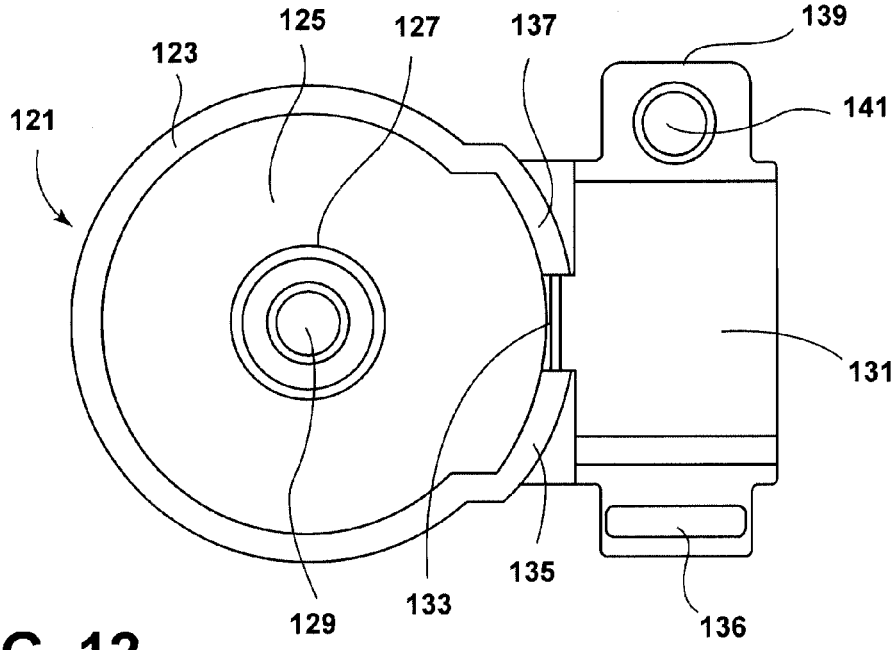
FIG. 12 is a top view of the conduit feed clamp bottom half of FIG. 11.

FIGS. 11 and 12 illustrate the bottom half 120 of the electrical conduit feed clamp 18 shown in FIG. 1, which may be fabricated of ZAMAK 3 in one embodiment. The clamp 18 includes a circular rear portion 121 with a an outer circular vertical wall 123 surrounding a flat floor 125. A cylindrical vertical boss 127 with a threaded cylindrical interior 129 is centrally positioned on the floor 125. In the illustrative embodiment, the wall 123 is concentrically positioned with the boss 127 and the interior threaded portion 129.

The bottom half 120 further includes a front entry way 131 of generally rectangular cross-section and a cable receiving opening 133. The cable receiving opening 133 is flanked on either side by respective arcuate walls 135, 137. A vertically disposed rectangular tab 136 is formed at one side of the entry way 131, and a boss 139 with a threaded opening 141 is formed on the opposite side.

Figure 13:
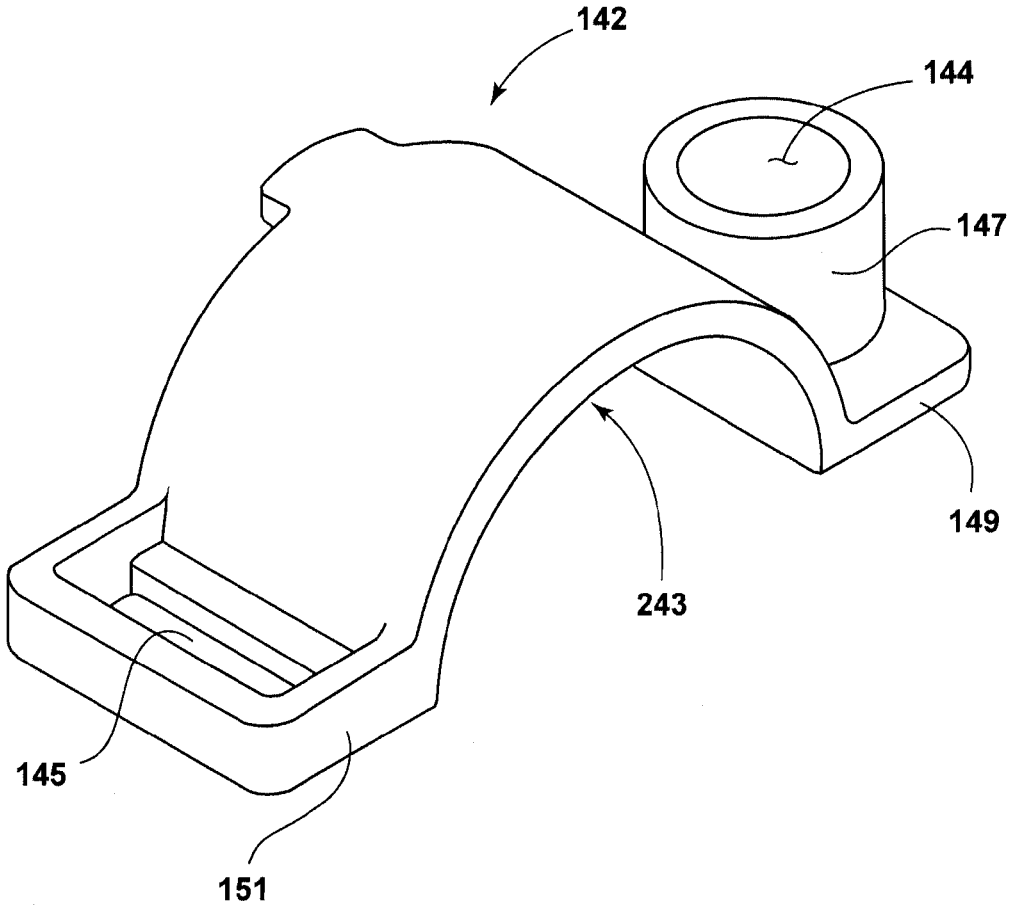
FIG. 13 is a perspective view of the top half of the conduit feed clamp.

The top half 142 of the conduit feed clamp 18 is illustrated in FIG. 13. The top half 142 includes a top or cover portion 243 of semicircular cross-section with an integrally formed slot 145 and vertically projecting cylinder 147 formed on respective horizontally projecting side surfaces 149, 151 thereof. As may be appreciated, the slot 145 is positioned, shaped and dimensioned to mate with the tab 136 of the bottom half 120 of the conduit feed clamp 18, while the cylinder 147 is positioned, shaped and dimensioned to reside concentrically over the threaded hole 141 such that a threaded fastening device such as a screw 143 (FIG. 1) may be used to fasten the top and bottom halves 120, 142 of the clamp 18 together.

Figure 14:
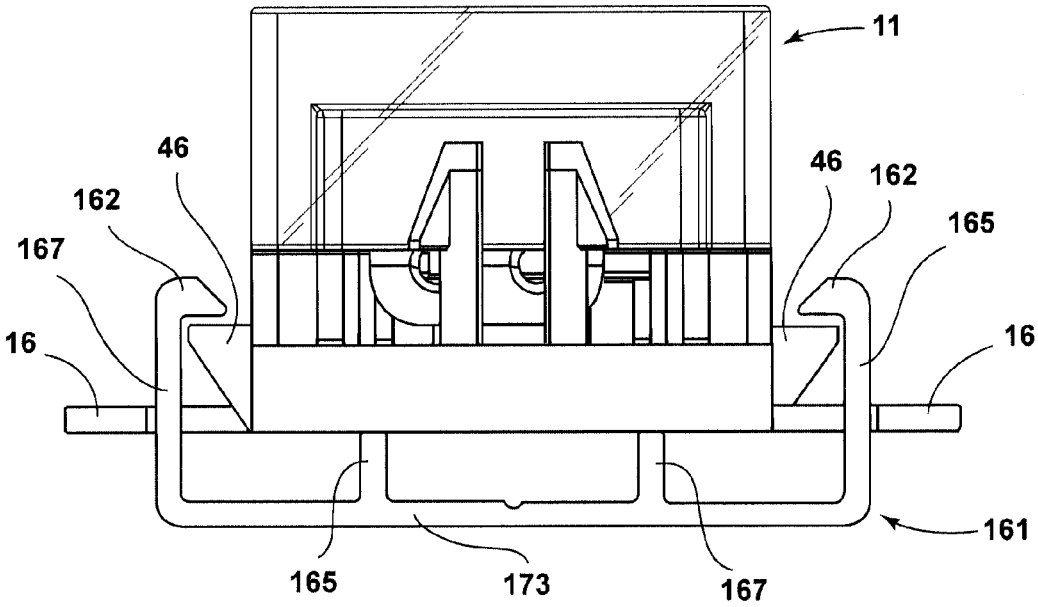
FIGS. 14 and 15 are end views of illustrative respective 0° and 15° mounting track embodiments.
Figure 15:
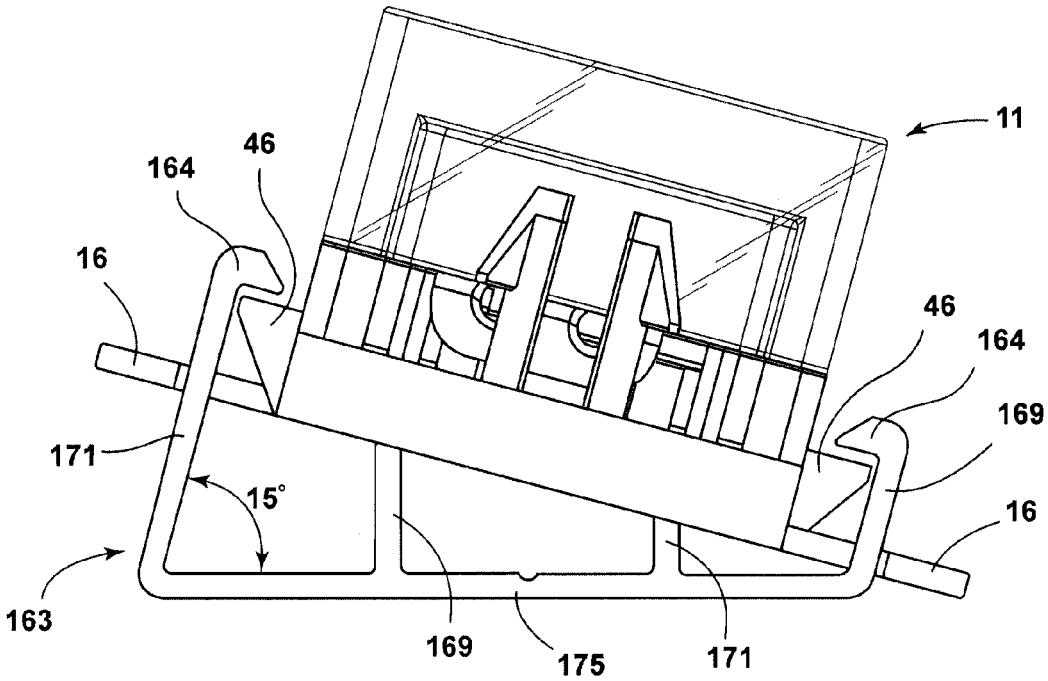

FIGS. 14 and 15 illustrate 0 degree and 15 degree mounting tracks 161, 163, which may be used to mount the modular units, e.g., 11 to a flat surface to direct illumination at either a zero degree of fifteen degree angle respectively. As may be seen, each mounting track 161, 163 respectively includes respective side fingers 162, 164 which extend through the holes in the horizontally extending side tabs 16 and engage the tabs 46 on respective sides of the base unit 19. The tracks 161, 163 further respectively comprise respective upright supports 165, 167; 169, 171, which in the illustrative embodiment are unitarily formed with a respective flat base portion 173, 175.

Figure 16:
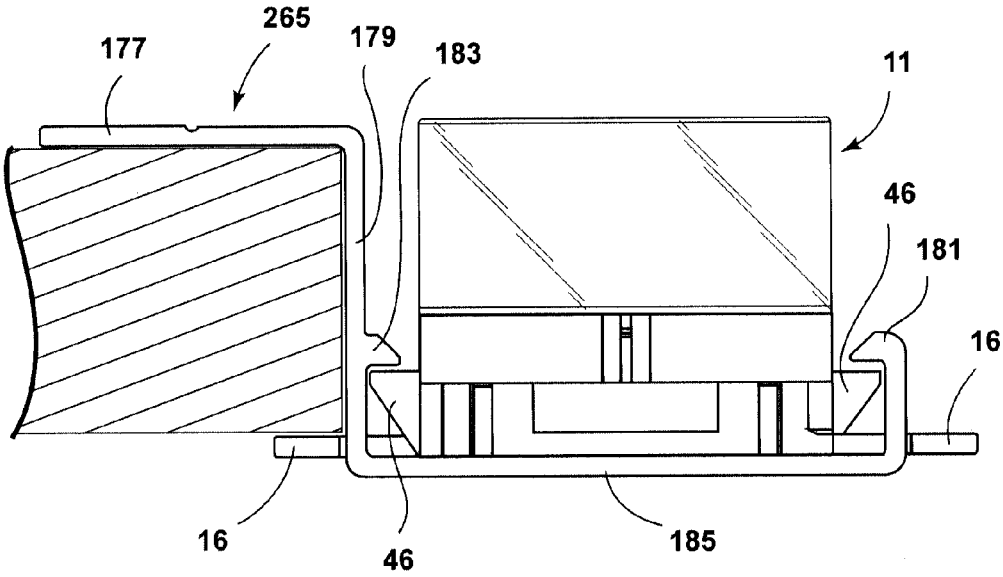
FIGS. 16 and 17 are end views respectively of illustrative edge and wall mounting track embodiments.
Figure 17:
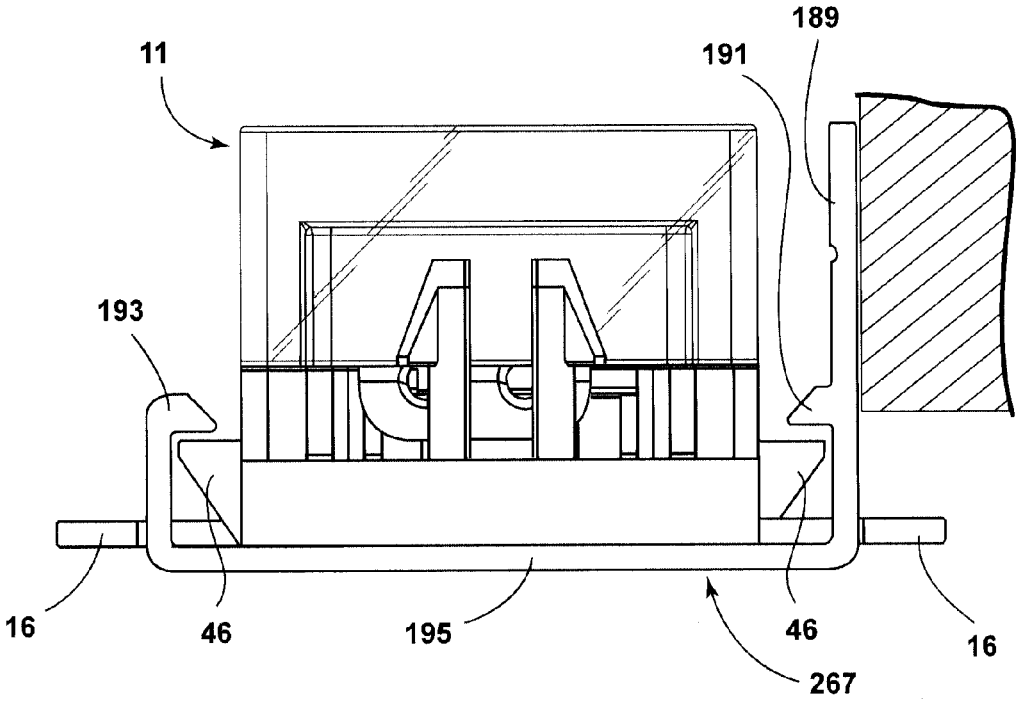

FIGS. 16 and 17 illustrate respective edge and wall mount mounting tracks 265, 267. The edge mount track 265 includes an appropriately positioned horizontal portion 177 unitarily formed with a vertical portion 179 such that the horizontal portion 177 may overlap and be fastened to an edge of an adjacent structural surface. Again, suitable fingers 181, 183 extend from a unitarily formed base portion 185 to extend through holes in the horizontal extending tabs 16 and grip the respective tabs 46. Similarly the wall mount track 267 includes a vertical flat surface 189, which facilitates mounting to an adjacent wall surface and fingers 191, 193 extending from a unitarily formed base portion 195 through holes in the horizontally extending tabs 16 to grip or engage the tabs 46. In illustrative embodiments, the mounting tracks of FIGS. 14-17 may be fabricated from a rigid PVC.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. An LED light fixture apparatus comprising:

a first base component having respective pairs of vertically projecting resilient tabs on first and second sides thereof, each resilient tab having a plurality of vertical ridges formed thereon;

the first base component further having a cylindrical recess formed at a first end thereof and a split vertical male plug positioned within the cylindrical recess;

the first base component further having a cylindrical female receptacle formed at a second, opposite end thereof and positioned within first and second outer fingers, the cylindrical female receptacle having a hole therein;

a second base component further having a cylindrical recess formed at a first end thereof and a split vertical male plug positioned within the cylindrical recess;

the second base component further having a cylindrical female receptacle formed at a second, opposite end thereof and positioned within first and second outer fingers, the cylindrical female receptacle having a hole therein;

the cylindrical female receptacle and split male plug of each of the first and second base components being so positioned, shaped, and dimensioned that the female receptacle of the first base component snap fittingly engages or otherwise interconnects with the split male plug of the second base component; and a cover component having respective pairs of openings on first and second sides thereof and respective depending surfaces located beneath each of the openings, the openings being so positioned, shaped and dimensioned that respective inner surfaces of the depending surfaces initially respectively contact the vertically projecting resilient tabs of the first base component as the cover component is pushed downwardly over the first base component, thereby pressing the pairs of tabs inwardly and thereafter allowing the tabs to snap fit into the respective openings in the respective sides of the cover component to thereby attach the cover component to the first base component.

2. The LED light fixture apparatus of claim 1 wherein the engagement or interconnection between the female receptacle of the first base component and the split male plug of the second base components enables the first and second base component to pivot with respect to one another.

3. The LED light fixture apparatus of claim 1 further comprising a conduit feed clamp pivotally mounted at an end of said second base component and configured to receive and hold an electrical conduit feed.

4. The LED light fixture apparatus of claim 1 further comprising a pin holder attached to an underside of the cover component and configured to receive a plurality of electrical leads, the pin holder having two power pins positioned to supply power to a plurality of LEDs mounted on a circuit board located on a top side of said cover component.

5. The LED light fixture apparatus of claim 1 wherein said cover member has an interior and wherein a rectangular edge or lip is formed in said interior and, said lip providing a ledge upon which rests a lens, said lip lying adjacent a vertical wall, said vertical wall further serving to position the lens.

6. The LED light fixture apparatus of claim 5 further comprising a circuit board located on a floor portion of the cover member below said lens.

7. The LED light fixture apparatus of claim 3 wherein said conduit feed clamp comprises (a) a circular rear portion with an outer circular vertical wall surrounding a flat floor and (b) a cylindrical vertical boss with a threaded cylindrical interior centrally positioned on said floor.

8. The LED light fixture apparatus of claim 7 wherein said conduit feed clamp further comprises a front entry way of generally rectangular cross-section and a cable-receiving opening.

9. The LED light fixture apparatus of claim 1 further comprising a mounting track, the mounting track including respective side fingers each extending through a respective hole in respective horizontally extending side tab formed on said second base component, each finger being configured to engage a tab located on a respective side of the second base component, the mounting track further comprising respective first and second parallel upright supports, each of which abuts a bottom surface of the second base component.

10. The LED light fixture apparatus of claim 1 further comprising a mounting track containing a flat vertical portion connected to a horizontal base portion, the horizontal base portion including respective lingers extending through respective holes in respective horizontal extending tabs formed on said second base component, said fingers further being configured to grip respective tabs formed on respective side surfaces of the second base component.

* * * * *